United States Patent [19]

Boston

[11] Patent Number: 4,584,201

[45] Date of Patent: Apr. 22, 1986

[54] RESEALABLE PACKAGE, METHOD OF MAKING AND USE

[75] Inventor: Louis R. Boston, Chittenango, N.Y.

[73] Assignee: Borden, Inc., Columbus, Ohio

[21] Appl. No.: 581,060

[22] Filed: Feb. 17, 1984

[51] Int. Cl.[4] ..... B65D 33/20

[52] U.S. Cl. ..... 426/106; 206/632; 383/89

[58] Field of Search ..... 383/89; 206/632; 426/106

[56] References Cited

U.S. PATENT DOCUMENTS

| | | | |
|---|---|---|---|
| Re. 27,361 | 5/1972 | Miller . | |
| 2,793,743 | 5/1957 | Lefebure | 383/89 |
| 3,149,771 | 9/1964 | Pearl | 383/89 |
| 3,313,471 | 4/1967 | Dickard et al. | 383/89 |
| 3,446,420 | 5/1969 | Rinecker | 383/89 |
| 3,504,475 | 4/1970 | Dickard et al. | 383/89 |
| 3,512,457 | 5/1970 | Watanabe . | |
| 3,515,270 | 6/1970 | Tonn . | |
| 3,608,707 | 9/1971 | Miller . | |
| 3,618,850 | 11/1971 | Palmer | 383/89 |
| 3,671,271 | 6/1972 | Miller . | |
| 3,827,625 | 8/1974 | Miller . | |
| 3,889,871 | 6/1975 | White . | |
| 3,942,713 | 3/1976 | Olson et al. . | |
| 3,990,627 | 11/1976 | Olson . | |
| 4,008,851 | 2/1977 | Hirsch | 383/71 |
| 4,276,982 | 7/1981 | Sibrava et al. . | |
| 4,318,506 | 3/1982 | Hirsch | 383/189 |
| 4,328,895 | 5/1982 | Jaeger | 383/89 |
| 4,348,440 | 9/1982 | Kriozere . | |
| 4,356,954 | 11/1982 | Mojonnier . | |

OTHER PUBLICATIONS

Photocopy of undated card entitled "Features of the Scotch® Resealable Closure No. 465".

Reprint of advertisement appearing in Modern Packaging, Package Engineering, and Business Week in Jan. or Feb., 1965, headed "How a Cheesemaker Traps New Business".

Photocopy of undated brochure headed "2 Laminating", showing a number of uses for transfer tape, including application to reclosable polyethylene bags for women's hosiery.

Temporary Product Information page dated May 1983 for "Scotch Brand High-Tack/Low Tack Double Coated Film Tape Y-9415", suggesting use for reclosable bags or envelopes.

Photocopy of undated 3M product page showing the use of No. 465 Adhesive Transfer Tape for bag and envelope closure.

Film Package for No Nonsense® "Regular", panty hose incorporating double-coated transfer tape resealable closure; package bears copyright date of 1980.

*Primary Examiner*—Stephen P. Garbe

*Attorney, Agent, or Firm*—Sidney W. Millard

[57] ABSTRACT

A flexible bag is formed to receive a product therein in fluid tight condition and in such bags it is customary to open the bag at one end. A seal strip is applied to the external surface of the bag during manufacture and when it is desired to reseal the bag after it has been opened, the bag is folded a plurality of times in the direction of the seal strip and the external surface of the bag is applied to an exposed adhesive on the seal strip and thereby the bag is resealed for storage of the contents.

15 Claims, 5 Drawing Figures

FIG. 2
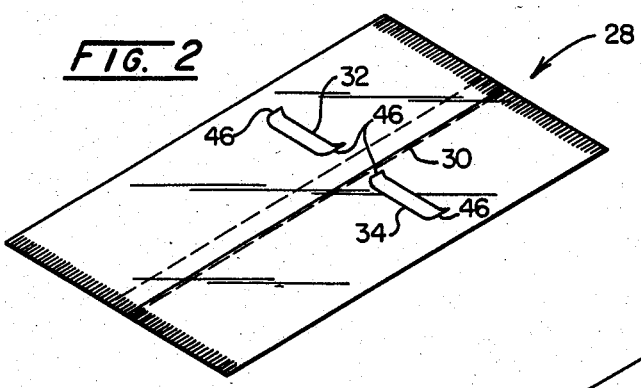
FIG. 3
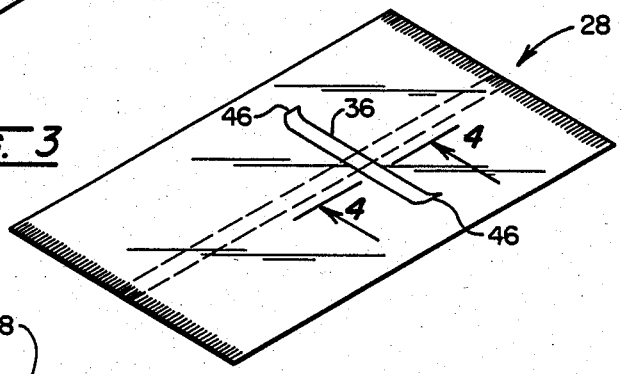
FIG. 5
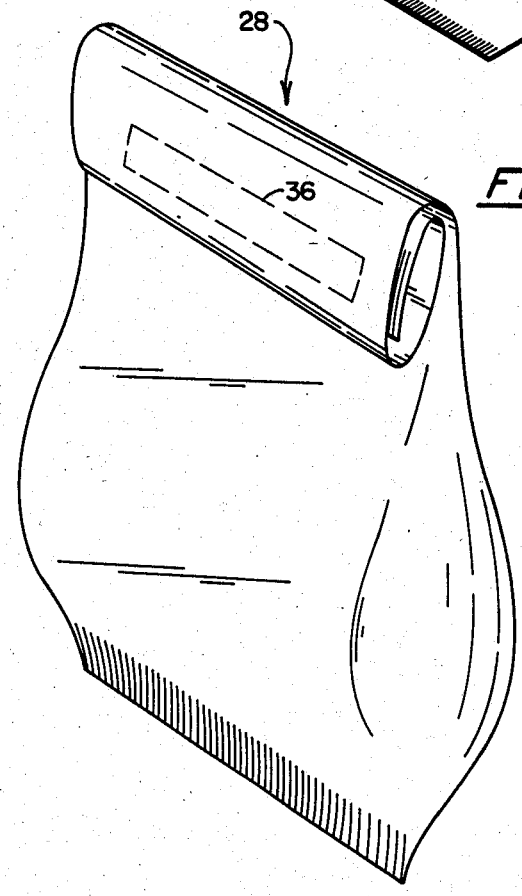
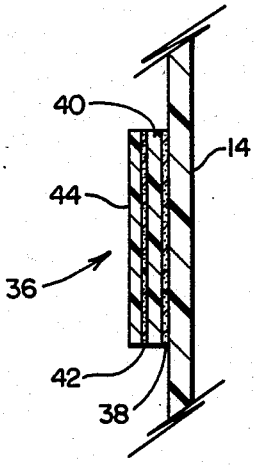
FIG. 4

RESEALABLE PACKAGE, METHOD OF MAKING AND USE

FIELD OF THE INVENTION

This invention is concerned with providing a package for moisture sensitive food products or the like which may be opened, a part of the contents removed and the bag resealed to prevent premature deterioration of the quality of the contents because of exposure to moisture in the air.

BACKGROUND OF THE INVENTION

Snack foods such as potato chips, corn chips, caramel corn, marshmallows and other moisture sensitive foods are conventionally stored in waxed paper bags or pouches of foil or heat sealed thermoplastic films and in their initial unopened condition the packages are effective in sealing the contents against destructive reaction with moisture in the air. By way of example, when potato chips and corn chips gain about 2% additional moisture by weight from the atmosphere, the resulting product is unappetizing and the flavor and texture deteriorate quickly. The product not only becomes soft, it becomes stale to the taste in a relatively short period of time.

Products have appeared on the market to reclose snack packages after they are opened and they include clothes pins, elongated clamps, metal reinforced "twist-ties" and resealable adhesive strips which serve as the initial seal on the package. The result is a success to a greater or lesser degree depending upon the aesthetics of the user. However, none of the aforementioned suggested solutions has been universally accepted and it is believed that the reason is the inconvenience to the customer or the expense to the manufacturer or both. Accordingly, this invention is designed to be universally acceptable to the consuming public because of the convenience provided to the user and to the manufacturer because of the lack of change in the manufacturing process and the minimal additional cost to employ a resealable feature on each and every package.

SUMMARY OF THE INVENTION

In at least one conventional manufacturing process, bags for snack foods are formed from an initial roll of flat preprinted flexible material which is fed first to a coder where various matter is imprinted thereon (such as the date) and subsequently to a former which folds the sheet into a package which is filled and subsequently sealed in conventional fashion.

In this invention a roll of a seal strip is provided within the conventional machinery between the roll of flat material and the place where the package is filled. Discrete lengths and said seal strip are applied to the flexible material in a position such that it will be on the external surface of the package when the package is formed.

The seal strip will include a peel strip which is removable to allow the package, when opened, to be folded down and sealed against an adhesive which will be exposed upon the removal of the peel strip. Not only does the resealed package minimize the passage of moisture, the contents are not exposed to insects, the contents cannot spill from the open top and a resealed package is more compact in size for storage. The resealed package will minimize moisture gain or loss by the contents.

Objects of the invention will be clear from a detailed reading of the description of the preferred embodiment and an observation of the drawings.

BRIEF DESCRIPTION OF THE DRAWINGS

FIG. 2 is a perspective view of an unfilled package with a seal strip applied to its external surface;

FIG. 3 is a second embodiment of the package of FIG. 2;

FIG. 4 is a fragmentary sectional view taken along line 4—4 of FIG. 3; and FIG. 5 is a perspective view of the package of FIG. 3 partially filled with product and being folded over to reseal the top according to this invention.

DESCRIPTION OF THE PREFERRED EMBODIMENTS

Figure 1:
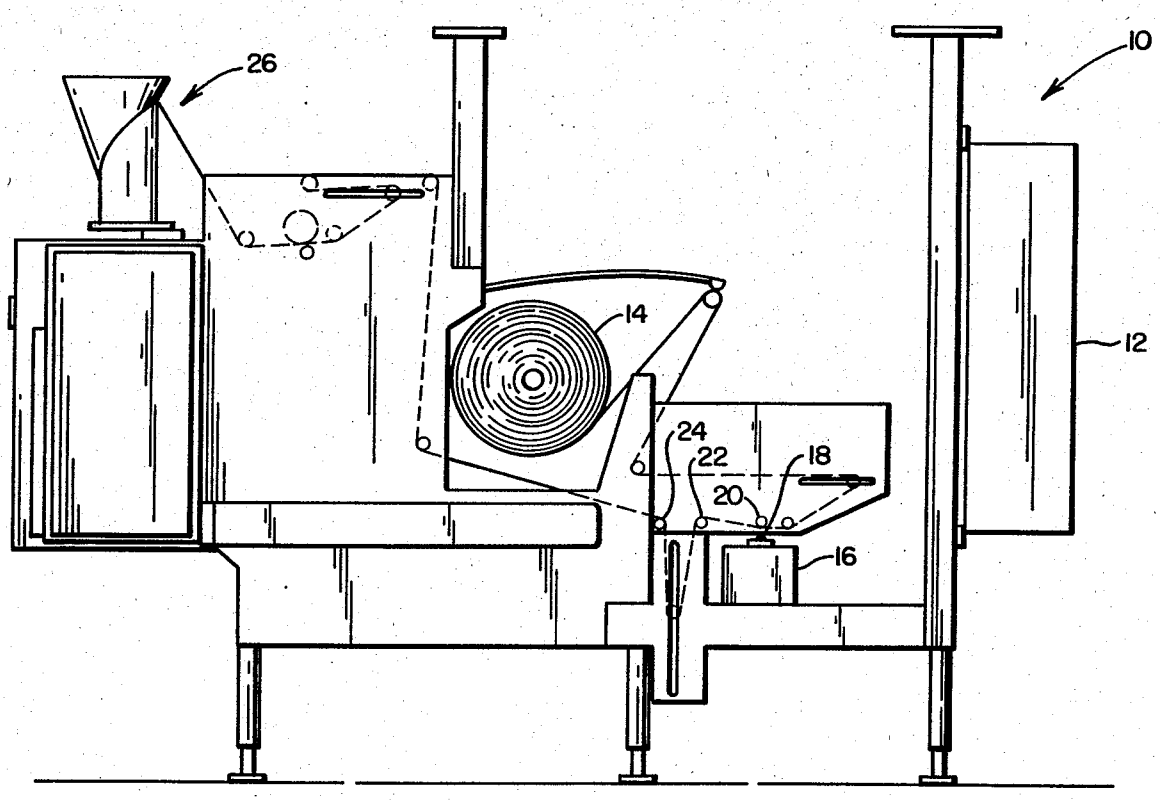
FIG. 1 is a schematic elevational view of a package manufacturing and filling apparatus.

FIG. 1 illustrates in schematic fashion a bag forming and filling apparatus 10. The apparatus is a high-speed operation and includes various light-actuated automatic controls and the like. Such are not illustrated in detail because they bear no relationship to the invention being described herein. A conventional control panel 12 may be adjusted according to the operator's desires in a given situation.

Within the apparatus is a roll of flexible material 14 which could be any of the conventional packaging materials such as paper, waxed paper, thermoplastic polymers, foil, metalized film and the like. Whether the material 14 is monolayer or a sandwich of a plurality of different layers depends upon the exact use intended but that is immaterial as far as this invention is concerned. Similarly, the thickness of the layer 14 is immaterial.

The usual rollers and tension control components are illustrated but will not be described in detail.

Someplace within the apparatus will be located a tape dispensing apparatus 16. Within the tape dispensing apparatus will be a roll of a seal strip (not shown) to be applied to one surface of the flexible material as it passes that work station. During the process of manufacture a length of tape or seal strip is drawn across the area of the flexible material but out of the flow path thereof and it is held in place on a porous plate 18 which holds it by the application of a vacuum. The porous plate moves to the surface of the flexible material and applies the tape thereto and severs it from the roll during the process although it is of no significance whether the length of tape is severed prior to, during or at the time of the plate moving the tape into contact with the flexible material.

It is preferred that the tape be applied in a position about one-third of the way down from what will be the top of the bag but the tape is desirably placed on the upper half. In fact, the tape is functional anyplace on the package as will be clear from the subsequent description. Placing the tape on the lower half of the bag could cause the user to crush the contents remaining in the bag when it is resealed but that depends upon the contents. The exact location of the seal strip depends upon the goods being packaged.

It should be stated that the vacuum and porous plate are so arranged that as soon as the plate applies the tape to the flexible material and begins its retreat from that surface, the vacuum will be released to allow the adhered tape to move along with the flexible material as it moves to the next work station.

It will be observed that a roller or platen 20 is arranged opposite the porous plate 18 to allow the plate to press the tape firmly against the flexible material without stretching or rupturing the material. During the manufacturing process the flexible material may move and stop periodically or it may be moving continuously. The roller 20 and plate 18 may be arranged to apply the tape in either fashion, that is they may apply the tape when the material is stopped or if it moves continuously, they would move with the material and then return to the starting point for the application of the next length of tape. The tape should be applied to the package prior to the time the package is filled because good adhesion requires a uniform pressure; with the goods in the package the surface would tend to be uneven and uniform pressure would be difficult.

Observing FIG. 1, the tape is applied by the plate 18 from below and there are two rollers 22, 24 shortly downstream from the point where the tape is applied and these serve the purpose of more firmly pressing the tape against the flexible material to ensure its adhesion. The adhesive used in the application of the tape depends upon the packaging material, but in some cases the cure is not instantaneous. The rollers 22 and 24 tend to press the tape firmly against the flexible material and enhance the bonding thereof.

At a point further downstream the flexible material goes through a former 26 which may also be the filling station where the product is inserted. The particular means for sealing the contents within the package such that it is in essentially fluid-tight condition will not be described here because such apparatus is conventional.

FIG. 2 illustrates an empty package 28 of a conventional design wherein the flexible material is folded and heat sealed longitudinally to form a tube and thereafter filled and heat sealed transversely to form a closed top and bottom. Essentially, there are two sides of the ultimate package where the front side will contain printing identifying the goods and the back side (illustrated facing upward in FIG. 2) includes the thermoplastically sealed fold 30 running longitudinally of the package.

The seal strip in FIG. 2 is illustrated as being in two parts 32 and 34, neither of which bridges over the fold 30. That is not to say that the seal strips 32 and 34 could not be one integral strip bridging the fold 30 but simply that placing two or more seal strips on the back portion of the package is not functionally distinct from placing one or more on the front of the package as shown in FIG. 3.

FIG. 3 illustrates another embodiment of the invention where a seal strip 36 is applied as a single length of tape extending 68 to 70% of the width of the front side of the package. This is the preferred width although a seal strip extending from 5 to 100% of the width of the package would be effective to accomplish the desired purposes of the invention depending upon the degree of "set" resulting from a fold applied to the package material. For example, folding aluminum foil might require only about a 5% width of seal strip whereas a polypropylene material might require a seal strip the full width of the package because of the memory of the polypropylene and its tendency to rebound to its original shape.

The seal strip 36 is really a composite of several layers of material which are best illustrated in the sectional view of FIG. 4 and is mounted on the outer surface of the package constructed of the roll of flexible material 14. An adhesive 38 bonds a layer of tape 40 to the flexible material. On the side of the tape remote from the flexible material 14 is a second adhesive 42 which has a bonding strength of less than the first adhesive 38. The reason for this is simple. It is desired that the seal strip 36 remain bonded to the external surface of the package material 14. Therefore, the bonding strength of the adhesive 38 must be greater than that of 42. Otherwise, the seal strip would peel off of the package when it adhered to a second surface in the manner to be described subsequently.

Because the adhesive 42 is of less peel strength than the adhesive 38, a peel strip or release liner 44 is bonded to the adhesive 42 and serves the purpose of preventing premature bonding of the seal strip to undesired surfaces.

Returning again briefly to FIGS. 2 and 3 it will be noted that the seal strips 32, 34, 36 appear to curve upwardly at each end 46. That is for illustrative purposes only and the strip in practice will in fact not be so distorted but rather will lie flat against the surface of the package. However, it is preferred that each peel strip 44 be longer than the length of the tape 40 by about one-quarter inch so as to provide an easy finger hold to allow the peel strip to be pulled from the adhesive 42 and discarded when it is time to reseal the package and such will be described in more detail subsequently.

A comment or two concerning the physical characteristics of the tape 40 and the liner 44 are in order because it is important that the materials not be so inelastic or rigid as compared to the material 14 that they release, crack or buckle during the manufacturing process or subsequent storage. Materials which may drag on the rollers and the former 26 should not be used where this type of equipment is used to form the bag 28. Therefore, the physical characteristics of the tape 40 and liner 44 should be such that their rigidity and elasticity do not cause manufacturing or storage problems. They could be the same characteristics but that is not critical. Thus, when the flexible material 14 stretches or bends there will not be a relative movement of the tape 40 with respect to the surface of the material 14. Premature release by a portion of the seal strip could result in a cutting of adjacent bags during shipment or placement on the display rack.

As one example of suitable materials for the seal strip, the tape 40 may be of unplasticized polyvinylchloride having a thickness of about 0.0035 inches and the peel strip 44 could be medium density polyethylene having a thickness of about 0.004 inches and acrylic based adhesives could be used.

A package of snack foods purchased by a consumer will ordinarily be taken to a residence and when it is opened the heat sealed portions at the top of the package are either pulled apart, the package is cut open or it is torn to provide an opening allowing the user to retrieve the contents of the package or a part thereof. Ordinarily, not all of a package of snack foods is consumed at one time and thus the desire to reseal the package is achieved where the package is manufactured according to the above discussed procedure. FIG. 5 is illustrative. The package 28 has been opened to remove part of the contents and resealed to prevent moisture from causing premature deterioration of the contents; the peel strip 44 has been stripped away from the adhesive 42 and two or more folds are made in the top portion of the package in a direction toward the seal strip 36. The folded portion of the package which previously represented the side of the package away from the seal strip 36 is adhered to the seal strip and thereby the package may be returned to a storage compartment for subsequent retrieval and consumption.

It is of note that as least two folds of the package must be made to ensure that the back side of the package or the one most remote from the seal strip 36 (or 32, 34) be folded over into contact with the seal strip. Failure to make the two or more folds will allow the top to gap open and the intent of the invention would be frustrated.

Based upon tests conducted, it is believed that resealed packages prepared according to this invention tend to preserve for longer periods moisture sensitive products, i.e. those which deteriorate upon gaining or losing moisture such as snack foods. The following shows experimental results where the atmosphere was maintained at 86° F. and 85% relative humidity and the results clearly demonstrate the effectiveness of the package herein described:

RECLOSURE SHELF LIFE TEST

| Product and Reclosure | Days Before Failure |
|---|---|
| Fried Cheese Doodles | |
| Open Bag, 8 oz. | <1 |
| Bag, 6 oz., with/Plastic Tie | 27 |
| Bag, 6 oz., Folded to Tape | 20 |
| 5½ oz., in Can | 20 |
| Cheese Curls, 6.5 oz. in Can | 27 |
| Corn Crunchies | |
| Open Bag, 10 oz. | <1 |
| Bag, 7 oz. w/Plastic Tie | 20 |
| Bag, 7 oz. Folded to Tape | 8 (flavor, texture) |
| 7½ oz., in Can | 27 |
| Corn Chips, 7½ oz., in Can | 27 |
| Baked Cheese Doodles | |
| Open Bag, 8 oz. | <1 |
| Bag, 6 oz. w/Plastic Tie | >20 |
| Bag, 6 oz., Folded to Tape | 20 |
| 4 oz. in Can | >20 |
| Cheese Balls, 5 oz. in Can | >20 |

The fried cheese doodles are in bags composed of a laminated sheet sequentially of polypropylene-polyethylene-polypropylene layers. The corn crunchies were also enclosed in bags formed from a three layered laminated sheet with the layers from outside inward being polypropylene-polyethylene-cellophane. The bags enclosing the baked cheese doodles were of a two layered sheet with polypropylene on the outside and cellophane on the inside.

In determining "failure" of the containers of goods to maintain suitable storage quality, the containers were all opened and reclosed in the stated environment. The products were then rated daily by a standard organoleptic rating system involving flavor, texture and aroma. The rating system was based upon the following hedonic scoring system:

9-like extremely
8-like very much
7-like moderately
6-like slightly
5-neither like nor dislike
4-dislike slightly
3-dislike moderately
2-dislike very much
1-dislike extremely At any time any one of the three areas being rated reached 5 or lower, the package was considered to have reached its point of "failure".

As may be observed, the actual tying of the flexible package and storage in cans does in some cases give longer useful shelf life than the invention described herein. However, the convenience afforded the consumer and the minimal cost to the manufacturer make this invention a desirable alternative.

While it has not been described or illustrated, it is clear that the tape could be applied near the top of the package. Then when it was to be resealed, the peel strip 44 would be removed and the bag folded twice in a direction away from the side where the tape is originally applied. At the completion of the second fold the adhesive 42 will contact the opposite side of the package and the seal will be accomplished.

Having thus described the invention, it will be clear that modifications could be made to the process, apparatus and product without departing from the spirit of the invention. For example, the seal strip could be adhesive applied directly to the bag covered by a peel strip. It is not intended that the drawings nor the language used to describe the invention be limiting. Rather it is intended that the invention be limited only by the scope of the appended claims.

I claim:

1. A resealable package containing a crushable product comprising, flexible material configured to enclose said product in fluid tight condition, to thereby form a package, said package having a top and a bottom, said fluid tight condition being accomplished at said top by a linear seal extending across said top, a seal across said bottom and a longitudinal seal extending longitudinally along one side from said top seal to said bottom seal, a seal strip mounted on the exterior surface of said package generally parallel with said top seal and spaced from said top seal a distance sufficiently great as to allow the package to be manually folded twice in a direction from the top toward the strip before the fold engages the strip, the seal strip being located on the package so as not to directly contact the longitudinal seal, said strip including a two-sided length of tape with the first side bonded to said surface by a first pressure sensitive adhesive of some strength, the second side of said tape being coated with a second pressure sensitive adhesive having a strength less than the strength of the first adhesive and having the characteristics of (1) bonding to both the tape and the exterior surface of the package and (2) in tension, releasing the package material before releasing the tape such that the second adhesive will remain on the tape when the surface of the package material separates from the second adhesive, a release liner bonded to the surface of the tape and covering the second adhesive, the second adhesive having the characteristic when in tension of releasing the liner prior to releasing the tape, the tape and release liner having a rigidity and elasticity about the same as that of the flexible material.

2. The package of claim 1 wherein the release liner is of greater length than the tape and at least one end of the liner projects beyond one end of the tape to provide a finger grip for removing the release liner.

3. The package of claim 2 wherein the package is formed to include two flexible sides of about the same height and width, the seal strip being on one of said sides spaced from both ends and being of a length in the range 68–70% of the width of that side.

4. The package of claim 2 wherein the package is formed to include two flexible sides of about the same heights and width, the seal strip being on one of said sides spaced from both ends and being of a length in the range 5–100% of the width of that side.

5. The package of claim 4 wherein the release strip extends beyond each end of the tape by a distance of about one-quarter inch.

6. The package of claim 1 wherein the package is formed to include two flexible sides of about the same height and width, the seal strip being on one of said sides spaced from both ends and being of a length in the range 5–100% of the width of that side.

7. The package of claim 6 wherein the seal strip is located on the half of the package nearest the top.

8. The package of claim 1 wherein the package is formed to include two flexible sides of about the same height and width, the seal strip being on one of said sides spaced from both ends and being of a length in the range 68–70% of the width of that side.

9. The package of claim 8 wherein the seal strip is located on the half of the package nearest the top.

10. The package of claim 1 wherein the seal strip extends across the one side parallel to the linear seal and about 50–100% of the width of the one side.

11. The package of claim 10 wherein the seal strip is located on the half of the package nearest the top.

12. The package of claim 1 wherein the first adhesive seals against a packaging material of polypropylene, the tape is comprised of unplasticized polyvinylchloride, and the release liner is comprised of polyethylene.

13. The package of claim 12 wherein the adhesives are comprised of an acrylic base.

14. The package of claim 1 wherein the adhesives are comprised of an acrylic base.

15. The package of claim 1 wherein said crushable product is edible.

* * * * *

UNITED STATES PATENT AND TRADEMARK OFFICE

CERTIFICATE OF CORRECTION

PATENT NO. : 4,584,201

DATED : April 22, 1986

INVENTOR(S) : Louis R. Boston

It is certified that error appears in the above-identified patent and that said Letters Patent is hereby corrected as shown below:

Column 1, line 57 should read: --- Discrete lengths of said seal strip --- rather than "Discrete lengths and said seal strip".

Signed and Sealed this

*Sixteenth* Day of *September 1986*

[SEAL]

*Attest:*

DONALD J. QUIGG

*Attesting Officer*

*Commissioner of Patents and Trademarks*